United States Patent [19]

Kunneke

[11] Patent Number: 4,727,669

[45] Date of Patent: Mar. 1, 1988

[54] TOOL FOR BREAKING UP ROCK OR LIKE STRUCTURES

[76] Inventor: Johan D. Kunneke, 34 Terral Ct., Reitz St., Sunnyside, Pretoria, South Africa

[21] Appl. No.: 658,116

[22] Filed: Oct. 5, 1984

[30] Foreign Application Priority Data

Mar. 7, 1984 [ZA] South Africa ..... 84/1699

[51] Int. Cl.[4] ..... F41C 11/02

[52] U.S. Cl. ..... 42/69.01; 42/106; 89/1.1

[58] Field of Search ..... 42/1 R, 1 L, 1 Z, 1.14, 42/1.15, 106, 69.01; 89/1.1

[56] References Cited

U.S. PATENT DOCUMENTS

| | | | |
|---|---|---|---|
| 2,888,768 | 6/1959 | Taylor | 42/1 L |
| 2,900,972 | 8/1959 | Marsh et al. | 42/1 L |
| 3,386,334 | 6/1968 | Temple et al. | 42/1 R |
| 3,619,927 | 11/1971 | Robinet | 42/1 Z X |
| 3,721,031 | 3/1973 | Falterman et al. | 42/1 L |
| 3,956,843 | 5/1976 | Litman | 42/1 G X |
| 4,004,488 | 1/1977 | Williams | 42/1 Z X |
| 4,268,987 | 5/1981 | Cash | 42/1 R |

*Primary Examiner*—Peter A. Nelson
*Attorney, Agent, or Firm*—Frost & Jacobs

[57] ABSTRACT

A rock breaking tool comprising a firing mechanism and firing chamber for discharging a blank cartridge into an impulse barrel. The impulse barrel has lateral openings and is intended to be inserted into a predrilled water filled hole in rock to be broken up. The barrel has a venturi throat for increasing cartridge discharge gas velocity.

9 Claims, 7 Drawing Figures

TOOL FOR BREAKING UP ROCK OR LIKE STRUCTURES

This invention relates to a tool for breaking up rock or like structures.

BACKGROUND OF THE INVENTION

Such tools are known, and are generally used where rock or the like has to be broken up without the use of explosives. One such tool known to the applicant comprises a firing chamber and firing mechanism for a blank cartridge, which is connected to an impulse barrel having lateral outlets for the cartridge discharge.

The tool is used by drilling a downwardly directed hole of suitable diameter into the rock or like structure which has to be broken up, filling it with water, and then inserting the tool into the hole and discharging the cartridge.

On insertion of the barrel, the water enters through the lateral holes to a depth just beneath the barrel throat, and the impulsive force of the discharged gas from the cartridge cause shock waves in the water in the barrel, which are transmitted through the lateral discharge outlets to cause the rock to split and break up.

As far as applicant is aware, these tools are not particularly successful, since they are of relatively low power and cannot be used to break up large areas of, or very hard, rock. Increasing the cartridge charge increases the dangers of using the tool, and can result in localised fracture of rock around the hole without effectively splitting or breaking the rock up.

OBJECT OF THE INVENTION

It is an object of this invention to provide a rock breaking tool and it is a further object of this invention to provide a firing mechanism which can, inter alia, be used in conjunction with such a tool.

SUMMARY OF THE INVENTION

In accordance with this invention there is provided a rock breaking tool comprising a firing chamber adapted to received a blank cartridge, a cartridge firing mechamism connected to the chamber, and an impulse barrel secured to the chamber and having lateral outlets therein adapted to convey an impulse force through water in the barrel in use, laterally outward to break a rock into which the barrel is inserted, characterised in that the barrel throat is tapered to create a venturi effect by accelerating cartridge discharge gases entering the barrel.

Features of the invention provide for the impulse barrel to have round lateral outlets spaced equally along its length, and preferably has four longitudinal rows of round outlets spaced equally around the impulse barrel circumference.

There is provided for these outlets to be diametrically opposed rows arranged in diametrically opposite pairs, the pairs of each two such rows being axially staggered with respect to each other.

An important feature of the invention provides for there to be two diametrically opposed sets of outlets, which outlets may comprise rows of longitudinally spaced apart outlets, or may be longitudinal slots.

There is further provided for the barrel throat to be part of a removable insert locatable within the barrel and having a progressively narrowing tapered venturi entrance and and exit which tapers outwardly, the commencement of the exit taper being positioned at or below the anticipated water level in the barrel in use.

Preferably the entrance taper has a ratio widest to narrowest diameter of approximately 1.7 to 1, and an angle of approximately 10° to the barrel axis. Further, the angle of taper of the exit of the insert is approximately 4° to the barrel axis, and the widest diameter of the exit taper of the insert is approximately equal to the barrel diameter and is smaller than the narrowest diameter of the entrance taper of the insert.

A still further feature of the invention provides for the firing chamber to be adapted to receive a cartridge of standard twelve bore shotgun size.

Preferably the barrel insert has an outwardly stepped portion around the throat thereof, which is received against the barrel and is secured in position by the screw threaded location of the barrel portion within a recess in the firing chamber body.

In accordance with a further aspect of the invention there is provided a firing mechanism having a body adapted to be releasably connected to a firing chamber, and housing a slidable firing pin biasable towards a striking position and movable to a cocked positioned, the rear of the firing pin carrying a screw threaded end cap screwable relative to the firing pin to react against the body and move the firing pin to a cocked position, the firing pin being adapted to cooperate with a trigger stop to hold the firing pin in the cocked position, and with the firing pin in this position, the end cap being screwable away from the body to allow firing pin travel between the cocked and the striking positions.

The trigger stop is preferably a trigger pin located in a transverse stop pin opening in the firing pin.

There is still further provided for the end cap to have a transverse opening therethrough rotatable to correspond with the stop pin opening which is located to be just outside the body with the firing pin in a cocked position.

Alternatively, there is provided for the firing mechanism to have a trigger guard located between the body and end cap, and which is rotatable relative to both to align a transverse opening therein with the stop pin opening, the stop pin opening being so alignable when the firing pin is in a cocked position.

The alternate firing mechanism can have a second transverse stop pin opening located to be alignable with the trigger guard opening when the firing pin is in a striking position.

In all cases, there is provided for a blowback gas escape passage between the striking end of the body and an outlet at the side of the body.

The biasing means is preferably a compression spring.

The alternate firing mechanism preferably has the body inwardly stepped at one end opposite the striking end to receive snugly in rotatably and releasably secured manner. The end cap also is preferably inwardly stepped at one end to be snugly received in a corresponding recess in trigger guard in rotatable manner.

The invention extends further to a method of cutting rock with a plurality of tools having diametrically opposed openings only, comprising drilling holes downwardly in the rock spaced apart along the desired cutting plane, substantially filling the holes with water and inserting a tool in each hole with the lateral outlets facing in the cutting plane, preparing tools for firing and substantially simultaneously firing all the tools.

BRIEF DESCRIPTION OF THE DRAWINGS

Preferred embodiments of the invention are described below by way of example only, and with reference to the accompanying drawings, in which.

DETAILED DESCRIPTION OF DRAWINGS

Figure 1:
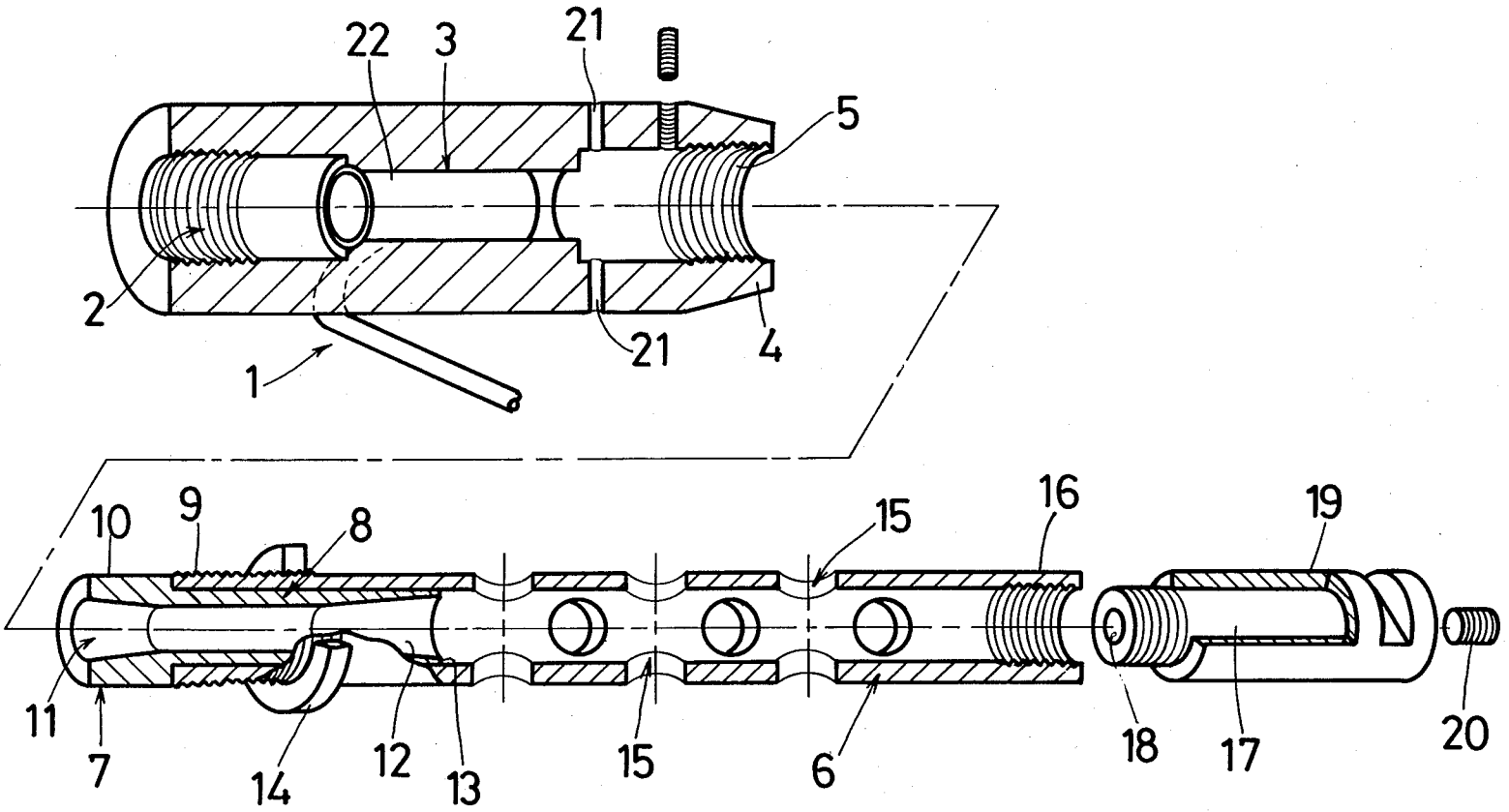
FIG. 1 is a partly exploded longitudinally sectioned isometric view of a barrel and firing chamber according to the invention; and, FIG. 2 is a longitudinally sectioned side view of a firing mechanism according to the invention.

Referring to FIG. 1, a firing chamber 1 comprises a cylindrical body having a screw threaded axial opening 2 at one end for receiving a firing mechanism, the firing mechanism opening leading axially further to a cartridge receiving opening 3, which is in communication at the barrel end 4 of the firing chamber with a further axial opening 5. This opening 5 is considerably wider than the cartridge receiving opening and is screw threaded to receive an impulse barrel.

An impulse barrel 6 is provided having the firing chamber end 7 thereof fitted with an insert 8 which extends therein. The barrel end 7 has external screw threading 9, and insert 8 has an outwardly stepped end 10 which fits against this end 7 with its outer surface almost flush with the screw threading 9.

The insert 8 has a throat 11 at the stepped end which is tapered down towards the interior of the barrel to a middle section which continues at the narrowest diameter of the taper, after which it tapers outwardly along a section 12, to meet, at a position 13, the inner wall of the remainder of the barrel length.

The barrel is provided with an external ring stop 14 adjacent the screw threading 9 remote from the barrel end 7. The remainder of the barrel is provided with diametrically extending staggered openings 15 as is known in the art.

The free end 16 of the barrel remote from the firing chamber end, is screw threaded to receive an end piece 17, which is cylindrical and has an axial opening 18 therethrough.

The end piece 17 is provided with a tough resilient covering 19 therearound, and has a grub screw 20 in the remote end of the axial opening 18 to block off this axial opening.

Radial openings (not shown) are provided in the end piece to allow communication between the axial opening 18 and the resilient covering 19.

The barrel is assembled with the firing chamber by inserting the end 7 with insert 8 into the opening 5 in the firing chamber, and screwing it up tightly. The joint is secured by a radial grub screw which is provided in the wall of the opening 5 in the firing chamber body. The insert 8 is thus secured in position with the stepped portion 10 and throat 11 against the cartridge opening 3.

In use, a cartridge 22 is inserted in the cartridge opening 3 of the firing chamber, and a firing mechanism is screwed in the opening 2. A firing mechanism suitable for this purpose is described below.

A predrilled hole in rock which is to be broken up is then filled with water. The barrel 6 is inserted end-first into the water until the stop 14 rests on the entrance surround of the hole.

In this position the water level will reach passed the tapered section 12 of the insert to the middle section thereof. Radial breather holes 21 are provided for this purpose in the wall to openings 5 in the firing chamber.

The cartridge 3 is then fired causing a discharge of gases, which is accelerated by the venturi effect of the throat 11 to impart an impulsive force to the water in the barrel, and this impulse force is transmitted through the water, through the lateral openings 15, to break up the rock. At the same time, the impulse in the water is passed through the radial openings in the end piece 17 to force the resilient covering 19 outwardly to grip the inner walls of the rock hole into which it is inserted. This gripping action inhibits any tendancy of the tool to be blown out of the hole.

Figure 2:
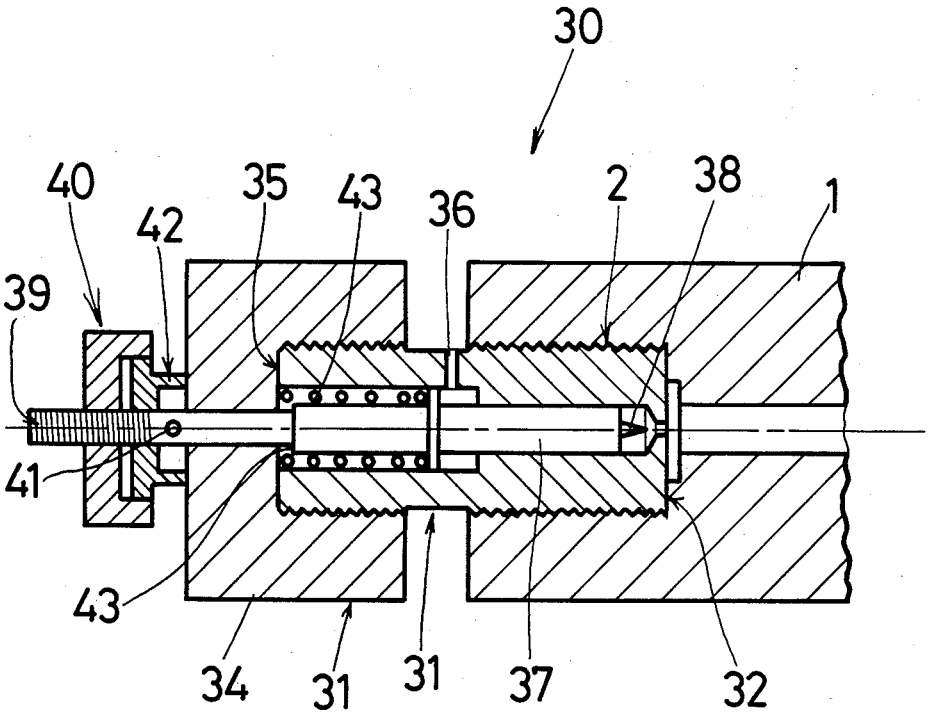

Referring now to FIG. 2, a firing mechanism 30 is shown, having a cylindrical firing pin housing 31 one end 32 of which fits in screw threaded manner into the entrance 2 of the firing chamber 1.

An end piece 34 in turn fits in screw threaded manner over the opposite end 35 of the housing 31. The end piece 34 stops short of the end of the firing chamber 2 and a radial opening 36 is provided in the holder between the cap and the firing chamber.

The firing pin housing and end piece house a slidable firing pin 37 in an axial opening therethrough. The firing pin has a striking head 38 at the one end for striking a cartridge in the firing chamber, and the other end 39 of the firing pin is of step-wise reduced diameter and extends through the end piece where it is threaded to carry a screw threaded knurled cap 40 thereon.

The firing pin 37, by a compression spring 43 thereround, is spring biased towards a striking position for firing a cartridge and slidable away therefrom against the spring biasing to a cocked position. The stepped section provides a stop to limit rearward motion of the firing pin under blow-back forces, and prevents the spring 43 from being damaged in use.

The cap 40 is screwable to engage against the end piece 34 and withdraw the firing pin to its cocked position. A radial opening 41 is provided in the firing pin for receiving a trigger stop pin therethrough. The cap 40 also has a transverse opening 42 through it, adjacent the end piece.

The cap 40 in use is rotated to cause the firing pin 33 to withdraw against spring biasing 42 until the hole 41 is outside the end piece 34. The cap is then adjusted to align the opening 42 with the pin opening 41. A trigger stop pin (not shown) is then inserted through the opening to hold the firing pin in its cocked position.

The cap 40 is screwed oppositely, to move it to the end of the firing pin remote from the end piece 34, and allow the firing pin to react against the trigger pin in the hole 41, under spring biasing. If the pin is now withdrawn, the firing pin moves under spring biasing to a striking position.

The firing pin is released by pulling on a lanyard connected to the trigger pin. It will be appreciated that in this type of mechanism the tolerances are not particularly close, and gases escaping from the cartridge opening in the firing chamber are permitted to escape to atmosphere through the radial opening 36, thus reducing blowback forces on the firing pin.

The cartridge loading is located with a conventional twelve bore casing, for which the firing chamber is bored.

Figure 3:
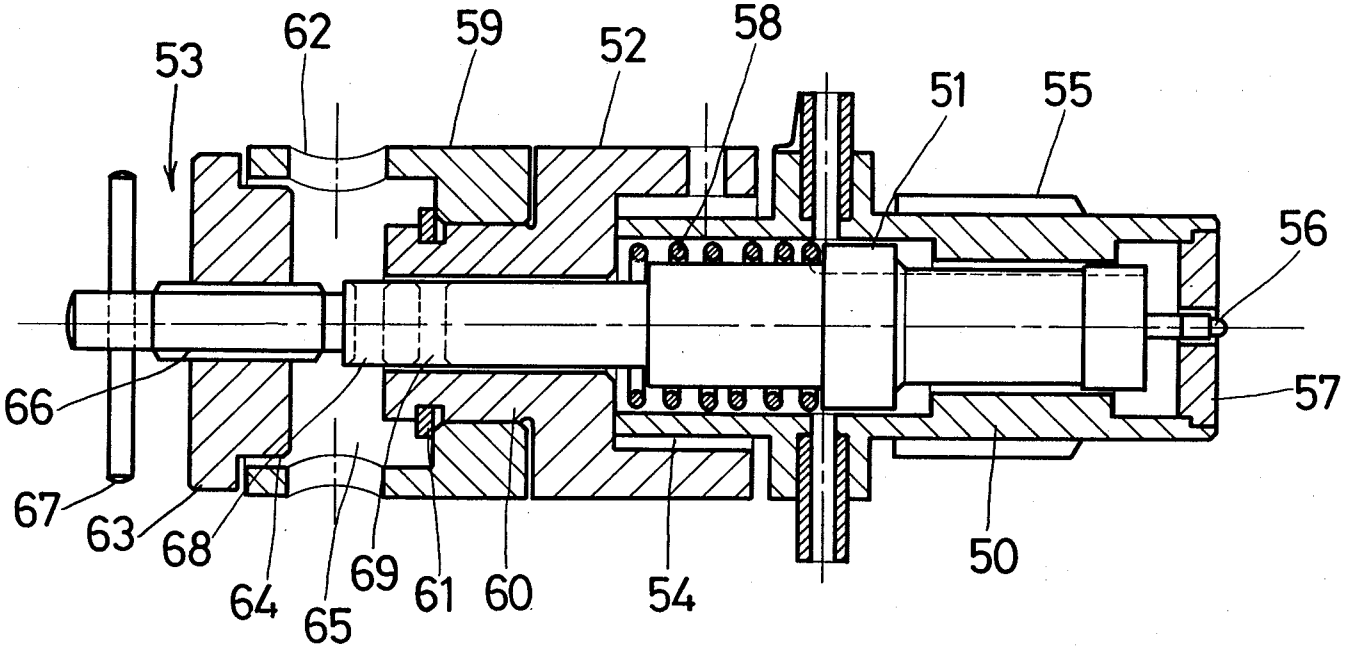
FIG. 3 is a longitudinally sectioned side view of an alternate firing mechanism according to the invention.

Referring now to FIG. 3, an alternative embodiment of a firing mechanism is shown. The embodiment is similar to that described with reference to FIG. 1, having a firing mechanism body 50, which houses a slidable firing pin 51 in an axial opening therein, and has an end piece 52 through which the rear portion 53 of the firing pin protrudes. The end piece 52 is screw threadly secured at 54 to the body 50. The body itself has screw threading 55 for securing the firing mechanism within an opening 2 in a firing chamber 1, as described above. The firing pin striking head 56 protrudes through an end wall 57 in the body 50.

The firing pin is biased by a compression spring 58 to the striking position and is slidable against the compression spring by rearward movement to a cocking position. Such rearward movement is caused by drawing the rear portion of the firing pin backwards against the spring. A trigger guard 59 is provided and seats concentrically around a projecting spigot 60 of the end piece 52, and is rotatable in co-axial manner round the firing pin. The trigger guard is secured in this position by a circlip 61 suitably located to hold it in its axial orientation. The trigger guard has a diametric opening 62 therethrough.

An end cap 63 is provided having a rebate 64 which fits rotatably within an end recess 65 in the trigger guard which forms part of the diametric opening 62 therethrough. The end cap 63 is secured by a screw threading 66 to be screwable around the rear portion 53 of the firing pin which extends through the end cap and has a transverse pin 67 therethrough remote from the end cap. Two transverse stop pin openings 68 and 69 are provided in the firing pin mechanism with one opening 69 being nearer the firing end and one end 68 nearer the cap end of the firing pin.

In use, the firing pin opening 68 is aligned with the transverse opening 62 in the trigger guard, which is considerably larger than the stop pin opening so that a pin located in the opening 68 will be adjacent the striking head side of the opening 62. The end cap 63 is rotated to screw the firing pin backwards against the spring biasing to a cocking position until the pin in the opening 68 reaches the opposite side of the opening 62. In this position, the opening 69 will also be aligned with the opening 62 in the position previously held by the opening 68. The stop pin can be removed from the opening 68 and inserted in the opening 69 to hold the firing pin in its cocked position by resting against the surface of the opening 62 on the striking head side.

It will be appreciated that the trigger guard is rotatable to align the opening 62 with the opening 68 or 69 as desired.

The end cap 63 is now screwed in the opposite direction to screw it away from the trigger guard 59 and up against the transverse pin 67 at the very rear end of the firing pin. The firing pin is now in a position to be fired by the removal of the transverse pin in the opening 69.

It will be further appreciated that the end cap in both the embodiments of the firing mechanism acts as a safety device, since although the firing pin may be withdrawn to a cocked position, it is not free to move until the end cap is rotated away from the firing mechanism body.

Figure 4:
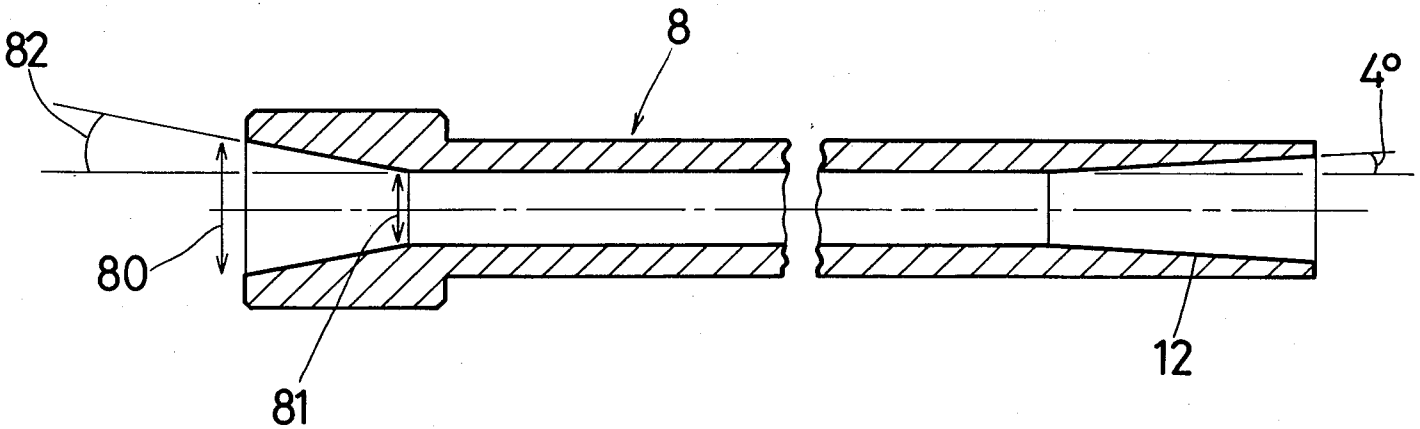
FIG. 4 is a sectional side view of a barrel insert of FIG. 1.

Referring to FIG. 4, details of the barrel insert 8 of FIG. 1 are shown. It has been found that a ratio of largest throat diameter 80 to smallest throat diameter 81 of 1.7 to 1 works effectively, with the angle of taper 82 approximately 10°. The exit taper section 12 of FIG. 1 has a taper of some 4°. For a barrel length of some 480 mm and an internal diameter of 18 mm, a diametric ratio as above of 1.73 to 1 is preferable for the throat, with a taper angle of 9.5°. The exit taper angle is 3.75°.

Figure 5:
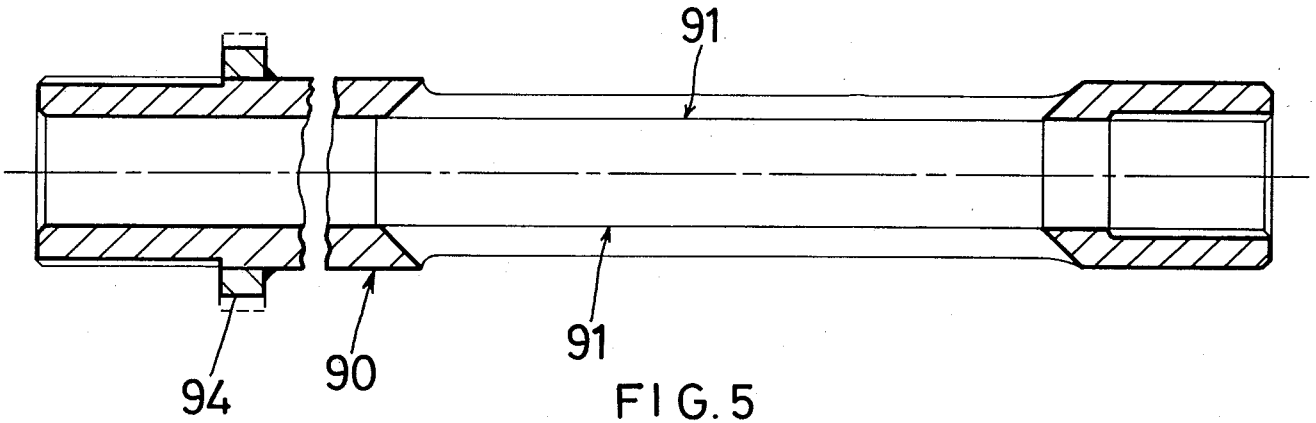
FIGS. 5 and 6 are sectional side views of alternate outlet configurations for a barrel.
Figure 6:
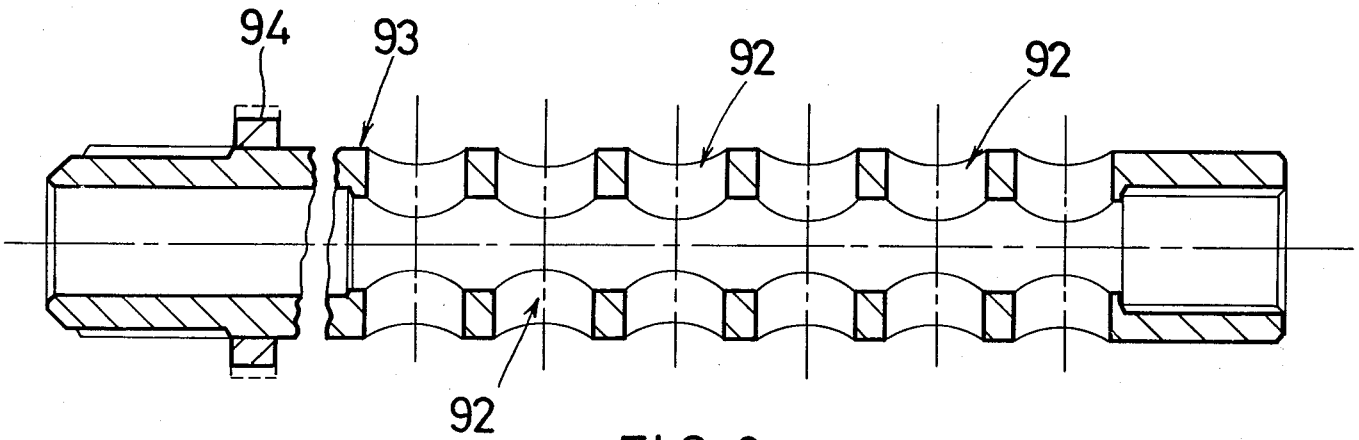

Referring now to FIGS. 5 and 6, alternative lateral opening configurations for barrels are shown. FIG. 5 shows a barrel 90 having two diametrically opposed longitudinal slots 91 running the length thereof. FIG. 6 shows two diametrically opposed rows of spaced apart openings 92 in a barrel 93.

It will be appreciated that the barrel length between the stops 94 thereof may be increased or decreased to suit various depths of holes drilled in various sizes of rock. The barrel insert described with reference to FIG. 4 will be lengthened or shortened to suit.

Figure 7:
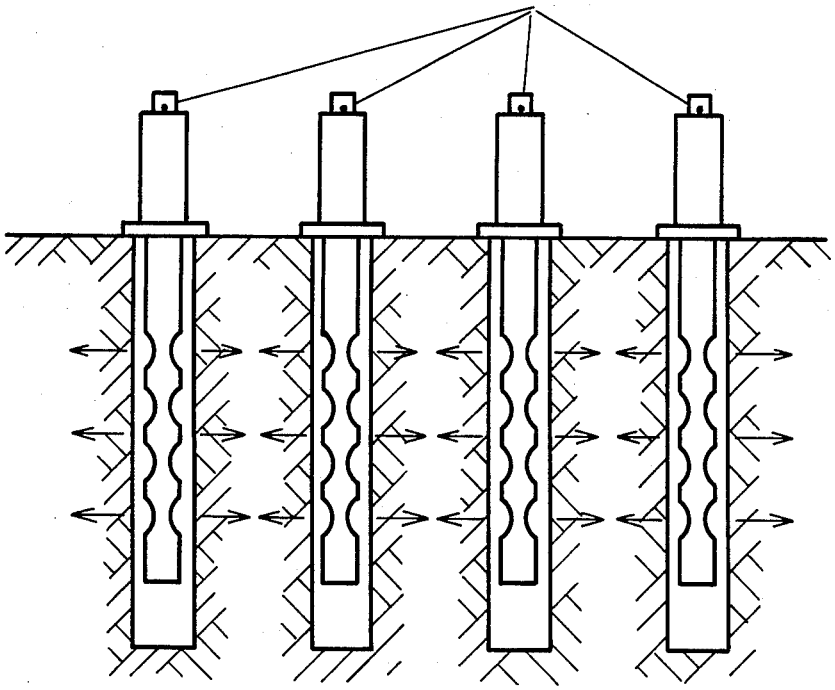
FIG. 7 is a diagrammatic view of a section along a desired cutting plane through rock illustrating a rock cutting method of the invention.

The barrels of FIGS. 5 and 6 are used in a cutting method for rough sizing of rock. This method. illustrated in FIG. 7, provides for holes 100 to be drilled along a desired cutting plane 101 to be cut in the rock 102, approximately 1 meter apart and for rock breaking tools 103 of FIG. 6 to be inserted in the water filled holes, with the diametrically opposed lateral openings facing in the cutting plane, as indicated by numeral 104. The lanyards 105 of the tools are pulled together, substantially simultaneous firing of all the tools in the holes to cause a split in the rock along the cutting plane. The harder rocks such as granite are more suitable for this kind of cutting.

It is considered that the invention provides a suitable rock breaking tool and a firing mechanism which can be used therewith.

I claim:

1. A firing mechanism having a body adapted to be releasably connected to a firing chamber, and housing a slidable firing in biasable towards a striking position and movable to a cocked position, the rear of the firing pin carrying a screw threaded end cap screwable relative to the firing pin to react against the body and move the firing pin to a cocked position, the firing pin being adapted to cooperate with a trigger stop to hold the firing pin in the cocked position, and with the firing pin in this position, the end cap being screwable away from the body to allow firing pin travel between the cocked and the striking positions.

2. A firing mechanism as claimed in claim 1 in which the firing pin has a transverse stop pin opening to receive a trigger stop in the form of a pin.

3. A firing mechanism as claimed in claim 2 in which the end cap has a transverse opening therethrough rotatable to correspond with the stop pin opening which is located to be just outside the body with the firing pin in a cocked position.

4. A firing mechanism as claimed in claim 3 in which there is a trigger guard located between the body and the end cap, and which is rotatable relative to both to a line a transverse opening therein with the stop pin opening, the stop pin opening being so alignable when the firing pin is in a cocked position.

5. A firing mechanism as claimed in claim 4 in which the firing pin has a second transverse stop pin opening located to be alignable with the trigger guard opening when the firing pin is in a striking position.

6. A firing mechanism as claimed in claim 1 in which a blowback gas escape passage is provided between the striking end of the body and an outlet at the side of the body.

7. A firing mechanism as claimed in claim 1 in which the biasing is a compression spring.

8. A firing mechanism a claimed in claim 4 in which the trigger guard is inwardly stepped at one end which end is received snugly and releasably in a secured corresponding body recess in rotatable manner.

9. A firing mechanism as claimed in claim 8 in which the end cap is inwardly stepped at one end to be snugly received in a corresponding recess in the trigger guard in rotatable manner.

* * * * *